United States Patent [19]

Dokoupil

[11] 4,438,570

[45] Mar. 27, 1984

[54] SYSTEM FOR DRYING AND EXPANDING OF FLAT MATERIALS SUCH AS LEATHER

[76] Inventor: Jiri Dokoupil, Hochstr. 9, 6251 Gückingen, Fed. Rep. of Germany

[21] Appl. No.: 241,543

[22] Filed: Mar. 13, 1981

[30] Foreign Application Priority Data

Mar. 15, 1980 [DE] Fed. Rep. of Germany ..... 3010003

[51] Int. Cl.[3] ..... F26B 3/34; F26B 23/04

[52] U.S. Cl. ..... 34/1; 34/16; 34/12; 34/41; 34/92; 34/151; 69/19.3

[58] Field of Search ..... 100/270, 278; 69/1.5, 69/41, 19, 19.3, 46; 34/1, 15, 16, 12, 18, 41, 143, 144, 151, 70, 92; 219/10.55 M, 10.55 R, 10.61 R

[56] References Cited

U.S. PATENT DOCUMENTS

| | | | |
|---|---|---|---|
| 3,151,952 | 10/1964 | Turato | 34/143 |
| 3,224,109 | 12/1965 | Turato | 34/143 |
| 3,426,558 | 2/1969 | Schmid | 69/46 |

*Primary Examiner*—Larry I. Schwartz
*Attorney, Agent, or Firm*—Horst M. Kasper

[57] ABSTRACT

An apparatus and process for expanding the area and for drying of leather pieces, felts and other similar flat materials. On both sides of the leather elastic foils impervious to air are disposed, a vacuum is connected to the space between the two foils and then forces are applied for enlarging the area of the foils, where the forces are predominantly disposed in the plane of the foils. Thermal energy can be fed to the flat material. The forces can be intermittently applied and they can be provided preferably by hydraulic or pneumatic means.

10 Claims, 3 Drawing Figures

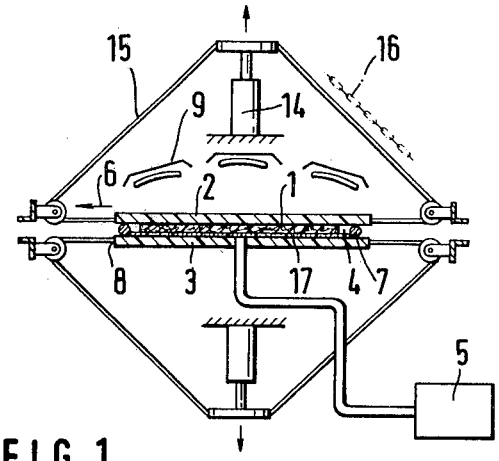
FIG. 1
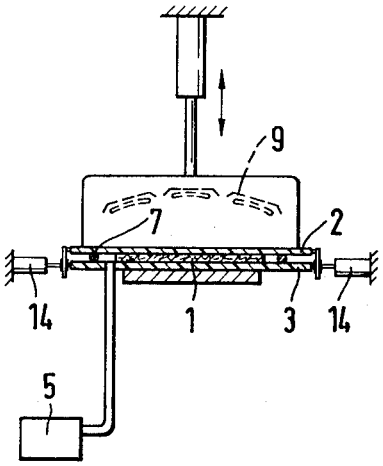
FIG. 2
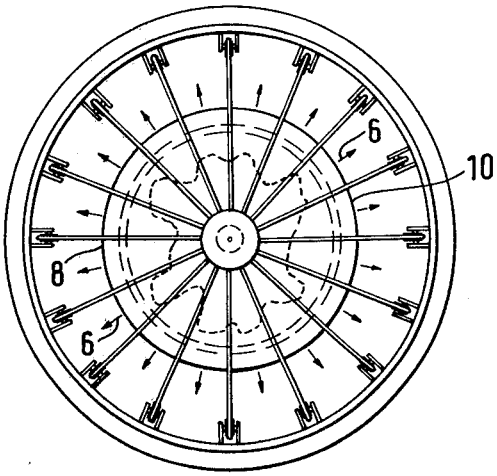
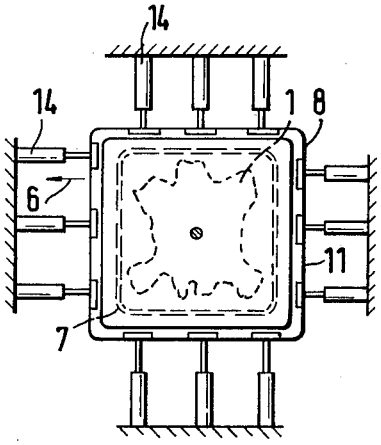
FIG. 3
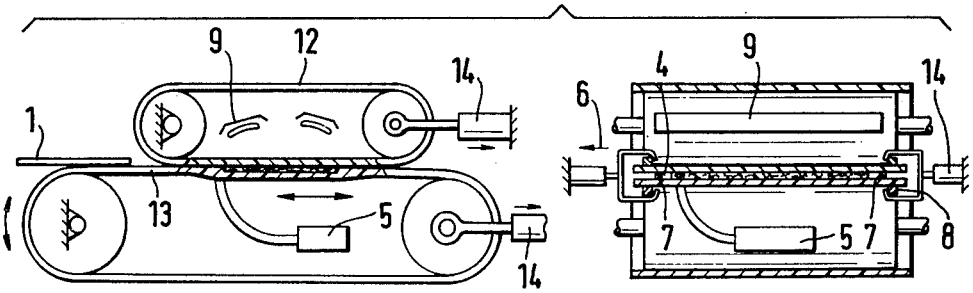

SYSTEM FOR DRYING AND EXPANDING OF FLAT MATERIALS SUCH AS LEATHER

DESCRIPTION

BACKGROUND OF THE INVENTION

1. Field of the Invention

The present invention relates to a method and to an apparatus for drying and for surface expanding of flat materials such as for example leather.

2. Brief Description of the Background of the Invention Including Prior Art

Stretcher frame dryers or tenter dryers are most effective for the increase in surface area during the drying of leather, since the leather is pretensioned on a stretcher frame or tenter prior to the drying process. It is one of the big disadvantages, that the pretensioning is performed manually employing a large number of so-called leather clamps, since the leather in general has a geometrically hard to determine contour.

SUMMARY OF THE INVENTION

1. Purposes of the Invention

It is an object of the present invention to provide an improved process for drying and stretching of flat materials.

It is another object of the present invention to provide a process for drying and expanding of flat materials which is suitable for automatic operation.

It is a further object of the present invention to provide an apparatus which can expand flat materials without employing so-called leather clamps and which does not require relatively considerable amounts of manual labor.

These and other objects and advantages of the present invention will become evident from the description which follows.

2. Brief Description of the Invention

The present invention provides a process for increasing the surface and for drying of flat materials such as leather pieces and hides which comprises placing the flat material between two foils impervious to air; connecting the space between the foils to a vacuum, and applying forces substantially disposed in the plane of the two foils for expanding the surface area of the two foils and of the flat material.

Thermal energy can be supplied to the flat sheet disposed between the two foils. The thermal energy can be supplied as radiative electromagnetic energy such as infrared radiation or high frequency energy of as thermal energy transferred by contact and/or convection. The forces on the foils can be applied intermittently.

There is also provided an apparatus for increasing the surface and for drying of flat materials which comprises at least two elastic foils impervious to air for disposing the flat material between the foils, a vacuum connector attached to one of the foils and connected to a source of vacuum, seals disposed between the two foils near the edges of the two foils and means for expanding the area of the two foils for thereby simultaneously expanding the area of the flat material.

The means for expanding the area of the two foils can comprise hydraulic means, pneumatic means or mechanical means acting on the edge areas of the foils. In a preferred embodiment the foils can be provided as conveyor belts serving simultaneously for the transport of the leather into the space for disposing the flat material. A heating means such as a radiation source or a heater can be provided to heat the foils and/or the flat material. The flat material can be of different kinds and compositions such as for example leather, hide, skin, pelt, fell and skin.

The novel features which are considered as characteristic of the present invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the invention FIG. 1 is a view of an apparatus for expanding and drying with a circular configuration;

FIG. 2 is a view of an apparatus for expanding and drying with a rectangular configuration;

FIG. 3 is a view of an apparatus for expanding and drying employing a conveyor belt type foil.

DESCRIPTION OF INVENTION AND PREFERRED EMBODIMENTS

The present invention eliminates the disadvantages of the conventional drying and expanding of leather by disposing on the two sides of the leather elastic foils impervious to air and connecting the space between the two foils to a vacuum and then expanding the area of the foils with forces predominantly disposed in the plane of the two foils. Thermal energy is fed to the leather located between the two foils by way of for example infrared radiation of the foils, by way of contact heat transfer or the humid leather is heated by way of high frequency energy.

The treatment of the leather can encompass the action of forces variable over time on the foils such as for example repeating, pulsating or oscillating forces.

Thus it is by way of the present process and/or apparatus possible to either dry the leather and to thereby optimally enlarge the area of the leather or to treat leather already finished, where its area is permanently expanded by a certain percentage.

Referring now to FIG. 1 there is shown an apparatus employing two foils 2 and 3 of circular shape 10. The leather 1 is disposed between the two foils 2 and 3. For example the complete upper part of the apparatus with the foil 2 could be removed to the top or to the side. Then the two foils 2 and 3 are brought together again. The space 4 is sealed by way of the seal 7 disposed near the edges 8 of the foils. The space 4 is connected to a vacuum 5. Now the atmospheric pressure pressed from the outside against the two foils 2, 3 and thus also against the leather 1. Ropes 15 are attached to the edger 8 of the two foils 2 and 3, which are fed via deflection pulleys centrally to a hydraulic cylinder 14. A roller system is employed for the two foils 2 and 3. If the hydraulic cylinders 14 are run out, a force is effected on the edges 8 of the two foils 2 and 3 by way of the ropes 15 such that the area of the two foils is increased. Since at the same time the foils are pressed against the leather 1 from both sides by way of the action of the atmospheric pressure, the leather follows the expansion of the two foils and the area of the leather increases. Upon return of the foils into the starting position the vacuum is removed. Upon repeated expansing of the foils the vacuum is newly provided. During the drying of the leather thermal energy is fed to the leather such as for example in the present construction employing infrared heater 9.

In the embodiment of FIG. 2 the foils 2 and 3 are constructed with rectangular or square shape 11. The force is exerted on the foils by way of hydraulic cylinders 14, which act directly on the edges of the foils. Since the hydraulic cylinders 14 act only on the lower foil 3, the upper foil 2 is mechanically taken along with foil 3 at the edges 8 in the stetching process. The course of the process is the same as the one used in connection with FIG. 1.

FIG. 3 shows construction, where the foils 2 and 3 form conveyor belts. The leather 1 is placed on the transport belt 13 and is spread and is then moved into the space 4 by way of the motion of the two transport bands. In this position the leather is sealed of by way of seals 7 disposed between the two foils and the space 4 is connected to vacuum. Hydraulic cylinders 14 are employed for stretching the two bands in longitudinal direction and the width is increased by the force 6 acting on the edges 8.

The leather 1 can be transported backwards for removal from the space between the two transport belts or the leather 1 can be continuously advanced and exits on the forward side. Again, it is possible in this embodiment to feed thermal energy to the leather by way of a radiator 9 or the space 4 can be disposed in an electromagnetic high frequency field.

Upon repeated action of forces on the leather during the drying process by dynamic action an increase in the handling properties of the leather can be observed, that is the leather becomes soft.

It will be understood that each of the elements described above, or two or more together, may also find a useful application in other types of system configurations and leather-processing procedures differing from the types described above.

While the invention has been illustrated and described as embodied in the context of an apparatus for expanding the area and for drying of leather, it is not intended to be limited to the details shown, since various modifications and structural changes may be made without departing from the spirit of the present invention.

Without further analysis, the foregoing will so fully reveal the gist of the present invention that others can, by applying current knowledge, readily adapt it for various applications that, from the standpoint of prior art, fairly constitute essential characteristics of the generic or specific aspects of the present invention.

What is claimed as new and desired to be protected by Letters Patent is set forth in the appended claims:

1. Process for increasing the surface and for drying of flat materials such as leather pieces and hides comprising:

placing the flat material between two foils impervious to air;

connecting the space between the two foils to a vacuum; and applying forces substantially disposed in the plane of the two foils for expanding the surface area of the two foils and of the flat material.

2. The process according to claim 1 further comprising supplying thermal energy to the flat sheet disposed between the two foils.

3. The process according to claim 2 wherein the thermal energy is supplied as radiative electromagnetic energy.

4. The process according to claim 1 wherein the forces are applied intermittently.

5. An apparatus for increasing the surface and for drying of flat materials comprising at least two elastic foils impervious to air for disposing the flat material between the foils;

a vacuum connector attached to one of the foils and connected to a source of vacuum;

seals disposed between the two foils near the edges of the two foils; and means for expanding the area of the two foils for thereby simultaneously expanding the area of the flat material.

6. The apparatus according to claim 5 wherein the means for expanding the area of the two foils comprises hydraulic means acting on the edge areas of the foils.

7. The apparatus according to claim 5 wherein the means for expanding the area of the two foils comprises pneumatic means acting on the edge areas of the foils.

8. The apparatus according to claim 5 wherein the foils are provided as conveyor belts serving simultaneously for the transport of the leather into the space for disposing the flat material.

9. The apparatus according to claim 5 further comprising heating means for providing heat to the flat material.

10. The apparatus according to claim 5 wherein the flat material is a member of the group consisting of leather, hide, pelt, fell and skin.

* * * * *